US006347526B1

(12) United States Patent
Ledbetter

(10) Patent No.: US 6,347,526 B1
(45) Date of Patent: Feb. 19, 2002

(54) AIR CONDITIONING OR HEATING REFRIGERATOR ASSEMBLY

(76) Inventor: Ricky G. Ledbetter, 2841 Alameda St., Medford, OR (US) 97504

( * ) Notice: Subject to any disclaimer, the term of this patent is extended or adjusted under 35 U.S.C. 154(b) by 0 days.

(21) Appl. No.: 09/668,795

(22) Filed: Sep. 22, 2000

(51) Int. Cl.[7] ..... F25D 15/00
(52) U.S. Cl. ..... 62/237; 62/440; 165/48.1
(58) Field of Search ..... 62/237, 412, 440, 62/448, 467, 337; 165/48.1, 61

(56) References Cited

U.S. PATENT DOCUMENTS

| | | | | |
|---|---|---|---|---|
| 1,716,766 A | * | 6/1929 | Cook | 62/440 |
| 2,914,927 A | * | 12/1959 | Corhanidis | 62/429 |
| 4,821,530 A | | 4/1989 | Ledbetter | |

OTHER PUBLICATIONS

Solid Door Reach–In Refrigerator/Freezer T–49DT, Jul. 30, 1999 (2 pages).
Totaline®Signature 24 Volt Programmable Thermostats, 01/99, Literature No. 570–559 (1 page).
NXAH Modular Air Handlers, 11/98, Coleman Evcon Technical Specifications (7 pages).
Coleman Evcon Cooler™10 Air Conditioner, 2/94, (4 pages).
Outdoor Split–System Air Conditioner, 9/98, Technical Data Sheet of Unitary Products Group (2 pages).
Outdoor Split–System Condensing Unit, 6/98, Installation Instructions, Unitary Products Group (11 pages).
CCX Series of Fully Cased Horizontal Fan Coil Units, 10/91 (1 page).

* cited by examiner

*Primary Examiner*—Henry Bennett
*Assistant Examiner*—Melvin Jones
(74) *Attorney, Agent, or Firm*—Robert E. Howard

(57) ABSTRACT

An air conditioning or heating refrigerator assembly, preferably for use in institutional kitchens. The refrigerator assembly includes a refrigerator unit having a cooling/heating coil subassembly mounted thereon, a blower subassembly mounted thereon downstream of said cooling/heating coil subassembly, and an air discharge chamber mounted on the top thereof. The cooling/heating coil and blower subassemblies are in air transport communication with each other, the blower subassembly being adapted to draw ambient air into the cooling coil subassembly and into contact with the cooling/heating coil, and to blow the cooled or heated air through an air discharge chamber into the atmosphere adjacent the refrigerator. In the air conditioning mode, the cooling/heating coils of the cooling coil subassembly are in communication with a condenser which supplies liquid refrigerant to the coils and condenses refrigerant vaporized in the coils.

4 Claims, 5 Drawing Sheets

AIR CONDITIONING OR HEATING REFRIGERATOR ASSEMBLY

BACKGROUND OF THE INVENTION

The present invention relates to an air conditioning or heating refrigerator assembly, particularly an air conditioning or heating refrigerator assembly for use in institutional kitchens. By "institutional" kitchens is meant kitchens of the size used in restaurants, schools, etc.

Because of the large number of items of heat generating equipment, such as stoves and refrigerators typically in use, institutional kitchens are notorious for becoming overheated, particularly during hot weather. Such overheating is not only uncomfortable for those working in the kitchen but it causes problems with equipment located in the kitchen, particularly refrigerators which can quickly become overtaxed and under perform in such conditions.

Central air conditioning typically is used to cool the entire premises, and cannot be turned down far enough to properly cool the kitchen without causing discomfort in the remainder of the premises.

Due to limited or non-existent window space, window air conditioning units usually cannot be installed in such kitchens.

U.S. Pat. No. 4,821,530, granted to the same inventor as the present invention, describes an air conditioning refrigerator having a cooling coil and blower located within a housing attached to the inside of the freezer compartment door with cool air flowing through apertures in the door. While such a device is suitable for cooling residential kitchens, it is inadequate to meet the needs of an institutional kitchen.

SUMMARY OF THE INVENTION

It is an object of the present invention to provide an air conditioning or heating refrigerator assembly capable of at least partially cooling or heating an institutional kitchen without taking up valuable space.

In one embodiment of the present invention, the air conditioning or heating refrigerator of the present invention is comprised of a refrigerator having an air conditioning or heating coil subassembly mounted thereon and a blower subassembly mounted thereon downstream of said coil subassembly substantially adjacent thereto and in air transfer communication therewith.

The coil subassembly, when adapted to provide cooling, is connected to a condensing unit by suitable conduits. Refrigerant is liquified in the condensing unit and pumped through the cooling coil of the cooling coil subassembly unit where it is vaporized and absorbs heat from ambient air passing over the cooling coils of said cooling coil unit. The vaporized refrigerant passes back to the condensing unit where it is condensed back into liquid refrigerant and recirculated through the cooling coil of the cooling coil subassembly.

The blower subassembly has a blower which pulls ambient air through the cooling/heating coil unit where the air is cooled or heated. The cooled or heated air is then blown by the blower through a duct to an air exhaust chamber located on the top of the refrigerator from which the cooled or heated air is blown through a diffuser grill to the atmosphere adjacent the refrigerator.

In a first embodiment of the present invention the air conditioning or heating coil subassembly and blower subassembly are both mounted on the back of the refrigerator.

In a second embodiment of the present invention, the air conditioning or heating coil and blower are both mounted on the top of the refrigerator.

DESCRIPTION OF THE PREFERRED EMBODIMENT

Figure 3:
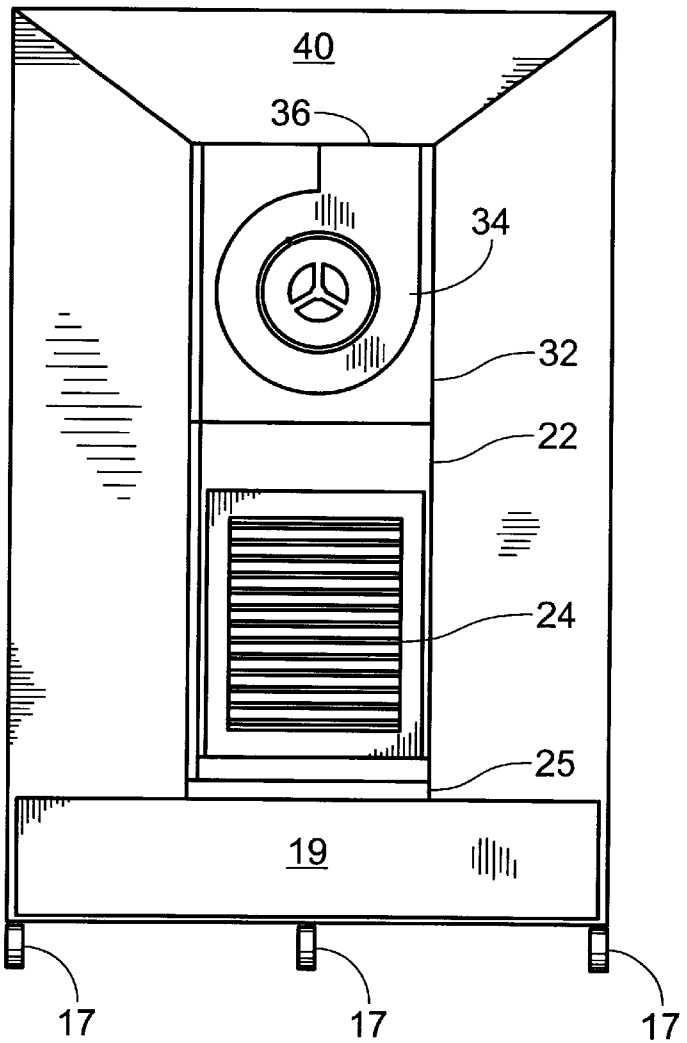
FIG. 3 is a rear view of the air conditioning/heating refrigerator of the present invention with enclosure covers removed.
Figure 1:
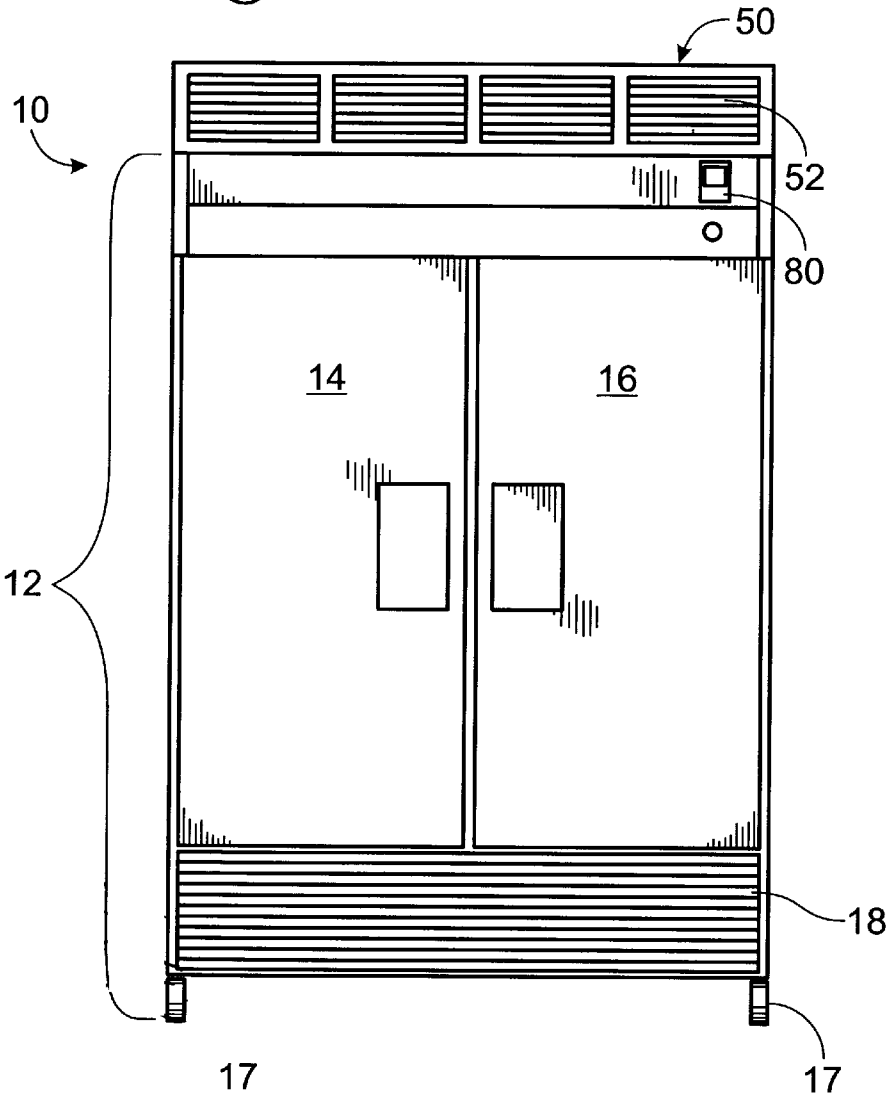
FIG. 1 is a front view of the air conditioning/heating refrigerator of the present invention.

The air conditioning/heating refrigerator assembly 10 of the present invention includes a conventional refrigerator unit 12. Conventional refrigerator unit 12 can be any refrigerator used in institutional kitchens. Typically such refrigerator units 12 have side-by-side doors 14 and 16 with a freezer being located behind one of the doors and a refrigerator being located behind the other door. The refrigerator unit 12 typically has a condensing unit located in the bottom thereof with heat being exhausted through grill 18 located in the front of the refrigerator unit 12, the condensing unit being accessible through an access door 19 located on the back side of the refrigerator unit 12.

Although the invention is not limited to a particular refrigerator unit design, a solid door reach-in refrigerator/freezer T-49 manufactured by True Food Service Equipment, Inc. of O'Fallon, Missouri is illustrative of those units suitable for use as refrigerator unit 12 of the present invention.

The invention will be primarily described as it is configured in its air conditioning mode. However, it is to be understood that the unit may be adapted to provide heated air as well.

In a first embodiment of the invention shown in FIGS. 1–7, an air conditioning cooling coil subassembly 20 is mounted on the back of refrigerator unit 12. A blower subassembly 30 is also mounted on the back of refrigerator unit 12 and substantially adjacent to cooling coil subassembly 20, preferably mounted on the top thereof, and attached thereto, as shown. Cooling coil subassembly 20 is attached to bottom bracket 25 affixed to the back of refrigerator unit 12 and blower subassembly 30 is attached to top bracket 35 affixed to the back of refrigerator unit 12.

Cooling coil subassembly 20 and blower unit 30 are in air transport communication with each other. A duct 40 communicates blower subassembly 30 with the back side of a cooled air exhaust chamber 50. Cooled air exhaust chamber 50 has a diffuser grill 52 located in the front thereof through which cooled air is blown into the room adjacent refrigerator unit 12.

Figure 4:
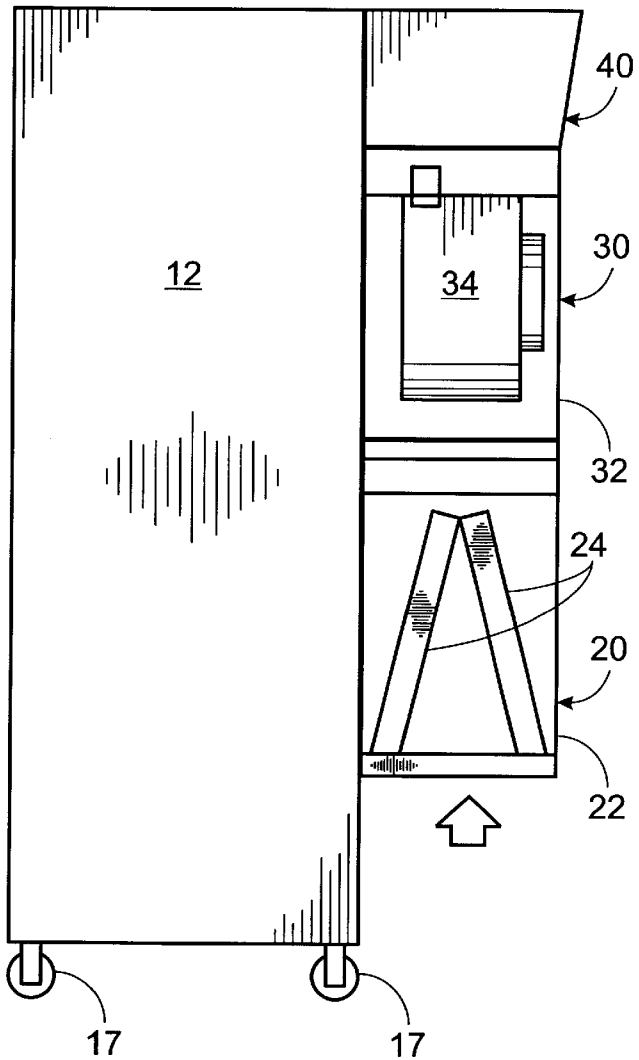
FIG. 4 is a side view of the air conditioning/heating refrigerator of the present invention with enclosure covers removed.
Figure 7:
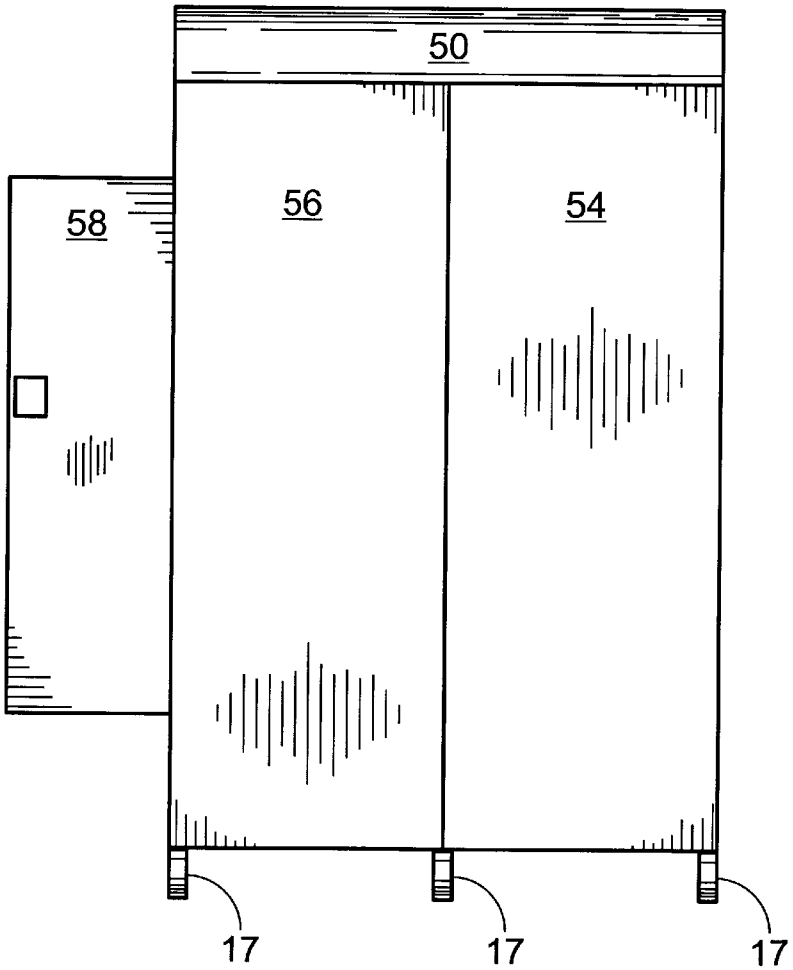
FIG. 7 is a rear view of the air conditioning/heating refrigerator of the present invention with enclosure covers in place.
Figure 6:
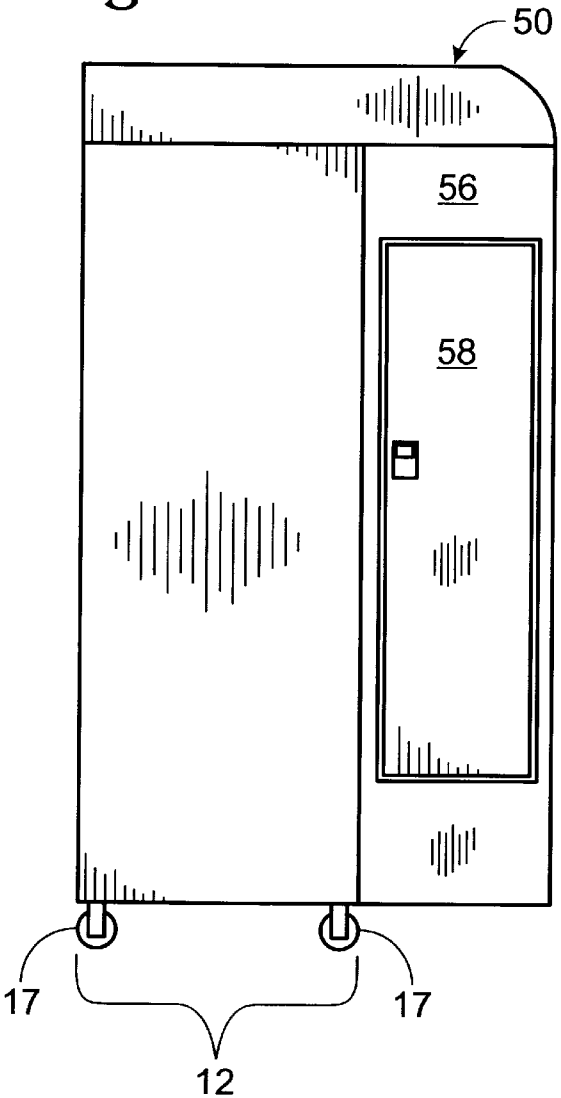
FIG. 6 is a side view of the air conditioning/heating refrigerator of the present invention with enclosure covers in place.

Cooling coil subassembly 20 is of a conventional design, having an insulated cabinet 22 containing a heat transfer member 24 comprised of staggered rows of rifled copper tubes mechanically expanded into aluminum fins to provide high heat transfer relative to the air to be cooled passing therethrough in the direction of the arrow shown in FIG. 4. A warm ambient air intake duct (not shown) and a cooled air exhaust duct (not shown) are located in the bottom and top of the cabinet 22, respectively, in a manner well known in the art.

Details of the cooling coil subassembly 20 are not described since such details are well known in the art. A suitable cooling coil unit is one manufactured by Coleman Evcon Model FD036S17 rated at 3 tons.

Cooling coil subassembly 20 is cooled by liquid refrigerant provided by condensing unit 60. Liquid refrigerant circulates from an outlet port in condensing unit 60 through conduit 62 and into a liquid refrigerant inlet port in heat transfer member 24 of cooling coil unit 20 where it vaporizes and cools air passing through heat transfer member 24. The vaporized refrigerant is circulated back to condensing unit 60, through conduit 64 (which is insulated), where it is condensed, all in a manner well known in the art.

Conduits 62 and 64 are preferably flexible refrigerant tubing made of suitable material such as copper, stainless steel, or aluminum. An excess "loop" of the tubing is provided adjacent the rear of refrigerator unit 12 to enable refrigerator assembly 10 to be rolled in and out of place on wheels 17.

Figure 2:
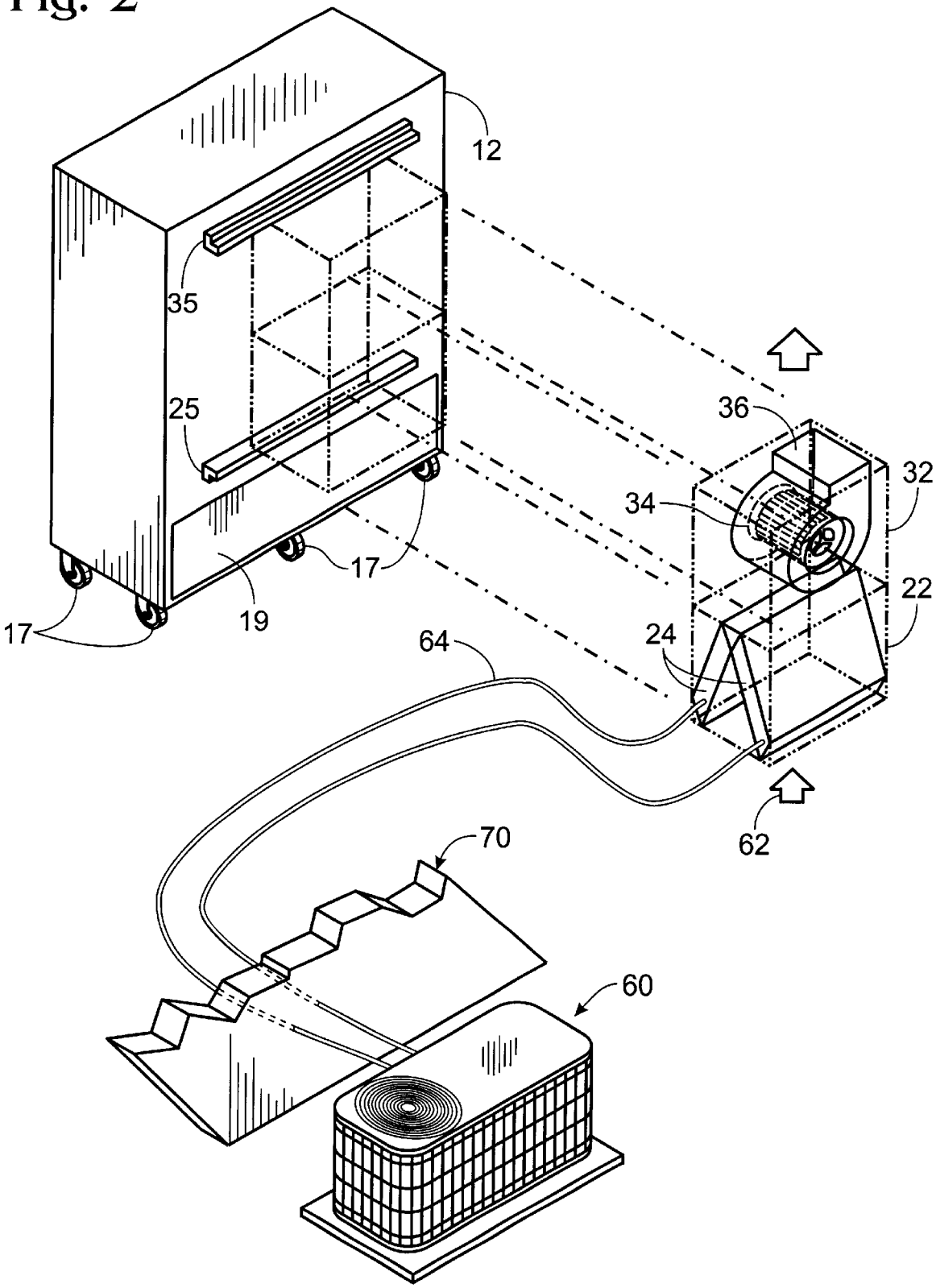
FIG. 2 is a partial, exploded, perspective rear view, partially in section, of the air conditioning/heating refrigerator assembly system of the present invention.
Figure 5:
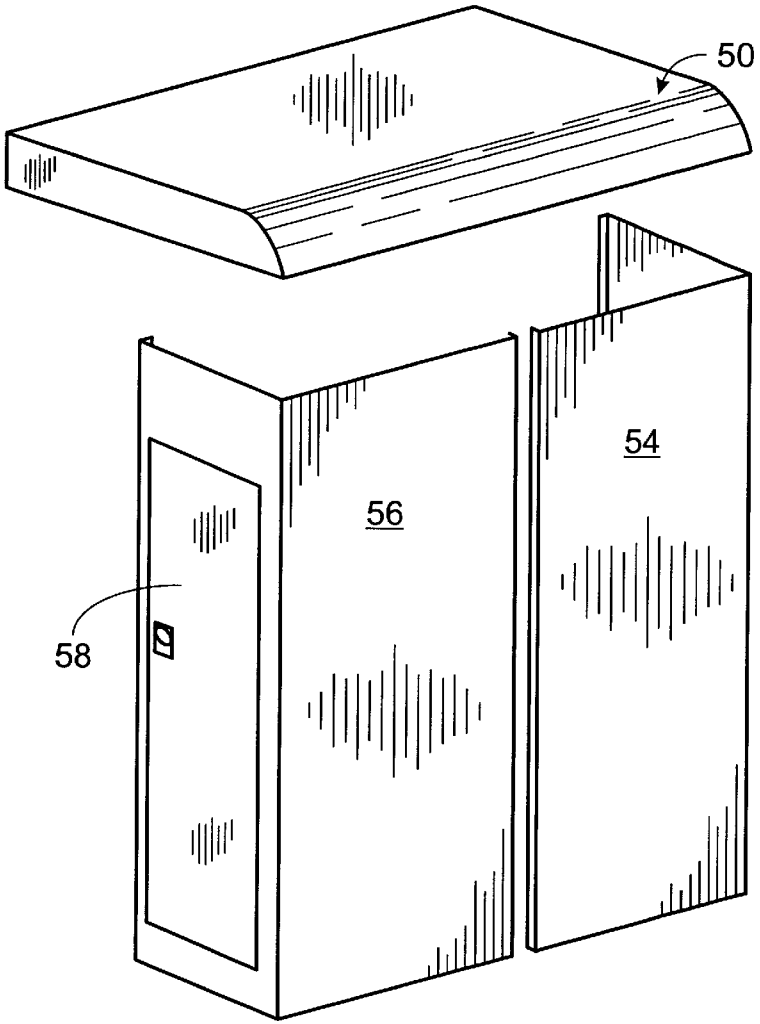
FIG. 5 is an exploded view of the air exhaust chamber and enclosure covers of the air conditioning/heating refrigerator of the present invention.

In order to dissipate the heat of condensation efficiently, condensing unit 60 is preferably located outside the building in which refrigerator assembly 10 is housed, the wall 70 of such building being partially illustrated in FIG. 2.

Details of condensing unit 60, such as motors, water connections, etc. will not be described since such details are well known in the art. A suitable condensing unit is Model BRCS0361BD manufactured by Coleman Evcon and rated at 3 tons.

Blower subassembly 30 has a cabinet 32 and a blower 34 powered by an electric motor (not shown). Preferably blower 34 is driven by a multi-speed, direct drive motor. Blower 34, being in air transport communication with cooling coil subassembly 20, is adapted to draw warm ambient air into cooling coil cabinet 22 and through heat transfer member 24 where the air is cooled. From cooling coil cabinet 22 blower 34 draws the cooled air into blower cabinet 32 through an opening in the bottom that communicates with an opening in the top of cooling coil cabinet 22. Blower 34 then forces the cooled air out of air exhaust port 36 and into duct 40.

Details of blower subassembly 30, such as electrical connections, etc, will not be described since such details are well known in the art. A suitable blower subassembly is one manufactured by Coleman Evcon, Blower Model AHB1201 rated at 2.5–3 tons.

A thermostat 80 is positioned in a pre-cut faceplate at an upper corner of the front of refrigerator unit 12. Thermostat 80 is electrically connected to blower subassembly 30 and condenser unit 60 in a manner well known in the art. A suitable thermostat is a digital thermostat manufactured by Totaline Signature, Model #P374-1100FM.

The cooling coil subassembly 20 and blower subassembly 30 are adapted to be attached together in a manner well known in the art. Bottom bracket 25 is aligned with the top edge of the refrigerator condenser access opening 19 and attached to the rear of refrigerator 12, as shown in FIG. 2. The combined cooling coil subassembly 20 and blower subassembly 30 units are placed on the bottom bracket 25 and the top bracket 35 attached to the rear of refrigerator 12 as shown in FIG. 2 and the combined units attached to the bottom and top brackets 25 and 35 by any suitable means, such as pop rivets.

After all wiring and plumbing is completed, cooled air exhaust chamber 50 is attached to the top of refrigerator 12. When in place, exhaust chamber 50 is in communication with exhaust port 36 of blower subassembly 30.

Enclosure covers 54 and 56 are then installed over the rear of refrigerator 12 to cover cooling coil subassembly 20 and blower subassembly 30. Enclosure cover 56 has an access door 58 located therein.

One of the advantages of the present invention, in addition to space conservation, is that by locating the air conditioning unit on the refrigerator unit, the cooled air circulating close to the refrigerator unit helps to keep the refrigerator unit itself cooler than it would otherwise be, which is especially important in hot weather.

While the invention has been described above relative to its air conditioning ability, the device may also be adapted to provide heated air by providing for cooling coil subassembly 20 to act as a heater by circulating hot water through the coil from a conventional source of hot water. Alternatively, a separate coil dedicated to provide heating from hot water circulating therethrough may be included within the cooling coil subassembly.

Figure 8:
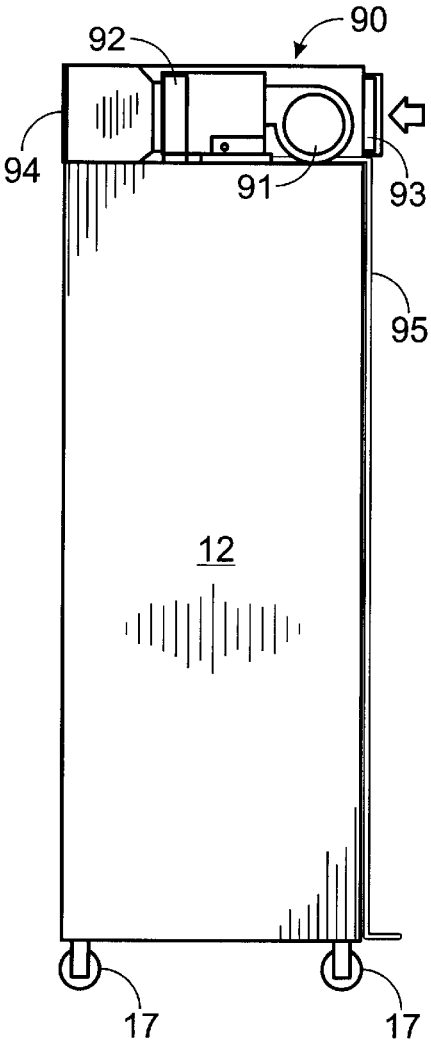
FIG. 8 is a side view of a second embodiment of the air conditioning/heating refrigerator assembly of the present invention, the air conditioning/heating unit being shown with its cover removed.
Figure 9:
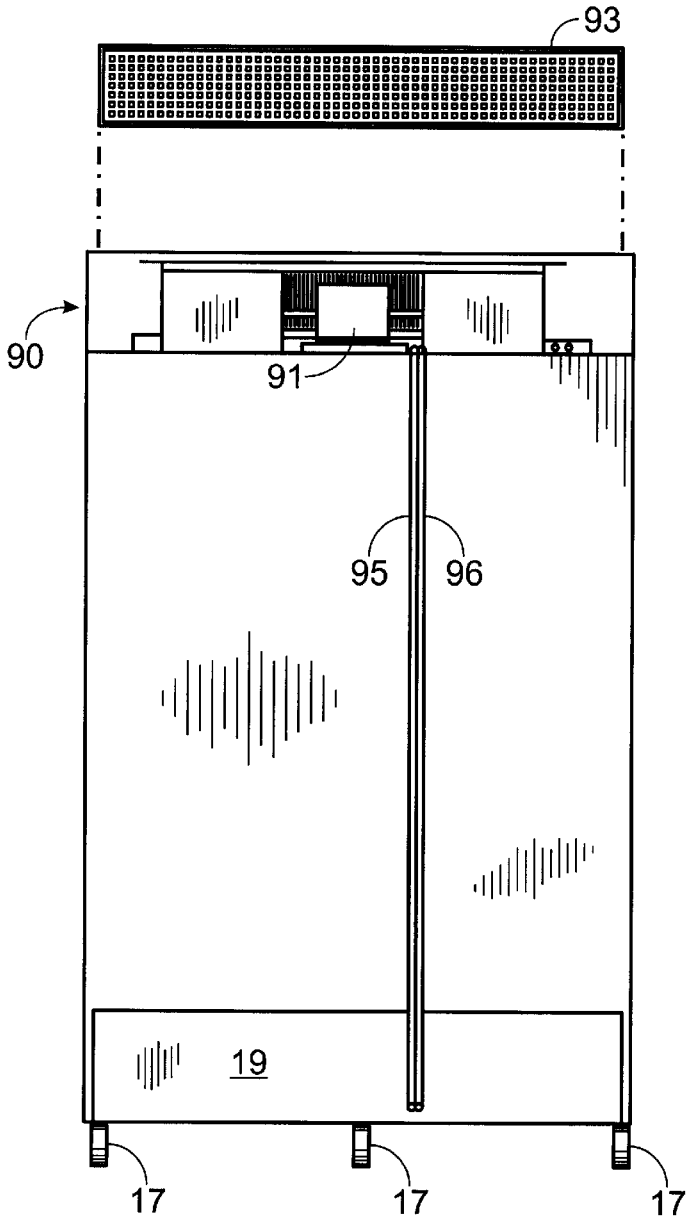
FIG. 9 is an exploded rear view of the second embodiment of the air conditioning/heating refrigerator assembly of the present invention.

A second embodiment of the invention is shown in FIGS. 8 and 9. In this embodiment an air conditioning/heating assembly 90 is located on the top of a conventional refrigerator unit 12.

Assembly 90 is comprised of a pair of blowers 91 operated by electric motor 97. Cooling/heating coil 92 is located in front of blowers 91 and adapted to either cool or heat ambient air being drawn through filter 93 and into the assembly 90 in the direction shown by the arrow in FIG. 8. Refrigerant may be supplied to coil 92 via supply line 95 and removed via return line 96 from a condensing unit such as unit 60 shown in FIG. 2. Where heated fluid is supplied to assembly 90 it may be supplied to coil 92 or a separate heating coil (not shown) via supply line 95 and removed via line 96 or separate supply and return lines, not shown.

The cooled or heated air is discharged from the front of assembly 90 through a stainless steel diffuser grill 94, which can be identical to diffuser grill 52 of the first embodiment. Assembly 90 is preferably covered with a stainless steel cover (not shown) which fits over the top and sides of assembly 90.

The air conditioning/heating assembly 90 may be any commercially available unit or one that is separately assembled as shown. A useful unit commercially available is one sold under the trademark "MagicAire" by CCX of Wichita Falls, Tex., available in 1.5 through 3 ton air conditioning sizes and having a height of less than eleven inches.

It will be obvious to those having skill in the art that many changes may be made to the details of the above-described embodiments of this invention without departing from the underlying principles thereof. The scope of the present invention should, therefore, be determined only by the following claims.

The invention claimed is:

1. An air conditioning/heating refrigerator assembly comprising:

a refrigerator unit having a front, back, sides, top and bottom;

a cooling/heating coil subassembly, said cooling/heating coil subassembly being mounted on said refrigerator, said cooling/heating coil subassembly having an ambient air intake port and a cooled/heated air exhaust port, said cooling/heating coil having an inlet port and an outlet port adapted to receive and discharge cooling or heating fluid, respectively;

means for circulating cooling or heating fluid to and from said cooling/heating coil via said inlet port and said outlet port, respectively;

a blower subassembly including a blower, an air intake port and an air exhaust port, said blower subassembly being mounted on said refrigerator unit substantially adjacent said cooling/heating coil unit downstream thereof, said blower subassembly intake port being in communication with said cooling/heating coil unit air exhaust port; and a cooled/heated air exhaust chamber mounted on the top of said refrigerator unit, said chamber adapted to receive cooled/heated air from the air exhaust port of said blower cabinet and exhausting said cooled/heated air into the ambient atmosphere.

2. The refrigerator assembly of claim 1 wherein said means for circulating a cooling or heating fluid to said cooling/heating coil is a condensing unit adapted to circulate liquid refrigerant to said cooling/heating coil inlet port and for receiving and condensing vaporized refrigerant from said cooling/heating coil outlet port.

3. The refrigerator assembly of claim 1 wherein said cooling/heating coil subassembly and said blower subassembly are mounted on the back of said refrigerator.

4. The refrigerator assembly of claim 1 wherein said cooling/heating coil subassembly and said blower subassembly are mounted on the top of said refrigerator.

* * * * *